US005976036A

United States Patent [19]

Jackson

[11] Patent Number: 5,976,036

[45] Date of Patent: Nov. 2, 1999

[54] BASEBALL GLOVE INSERT TRAINING AID

[76] Inventor: Derry A. Jackson, 9540 North Edison, Portland, Oreg. 97203

[21] Appl. No.: 08/969,166

[22] Filed: Nov. 12, 1997

Related U.S. Application Data

[60] Provisional application No. 60/030,805, Nov. 12, 1996.

[51] Int. Cl.[6] ..... A63B 71/02

[52] U.S. Cl. ..... 473/458; 2/19

[58] Field of Search ..... 473/425, 464, 473/458; 2/10, 18–20; 223/78, 79

[56] References Cited

U.S. PATENT DOCUMENTS

| | | | |
|---|---|---|---|
| 183,045 | 10/1876 | Dunlop . | |
| 538,572 | 4/1895 | Wilson . | |
| 606,628 | 6/1898 | Hull | 223/78 |
| 907,137 | 12/1908 | Fenohr | 223/78 |
| 942,262 | 12/1909 | Iverson . | |
| 1,562,176 | 11/1925 | Latina . | |
| 3,141,173 | 7/1964 | Jackson et al. . | |
| 3,486,670 | 12/1969 | Sutton | 223/78 |
| 4,121,824 | 10/1978 | Hirschfield | 473/458 |
| 4,208,051 | 6/1980 | Robertson | 473/458 |
| 4,472,836 | 9/1984 | Shikatani | 223/78 |
| 4,637,610 | 1/1987 | Carr | 473/458 |
| 4,748,690 | 6/1988 | Webster | 2/19 |
| 4,802,669 | 2/1989 | Birmingham | 473/458 |
| 4,817,209 | 4/1989 | Lehmann et al. . | |
| 4,874,168 | 10/1989 | Wright | 473/458 |
| 5,011,053 | 4/1991 | Davies | 223/78 |
| 5,125,169 | 6/1992 | Bader | 223/78 |
| 5,155,864 | 10/1992 | Walker | 223/78 |
| 5,234,141 | 8/1993 | Spiece | 223/78 |
| 5,346,208 | 9/1994 | Wood . | |
| 5,601,285 | 2/1997 | Baxter . | |
| 5,671,477 | 9/1997 | Aoki . | |

*Primary Examiner*—Steven Wong
*Attorney, Agent, or Firm*—Kolisch Hartwell Dickson McCormack & Heuser

[57] ABSTRACT

An insert to provide stiffness to a baseball glove. Conventional baseball gloves have cavities for receiving the digits and palm of a hand. The insert includes a central expanse, a first elongate extension extending outwardly from the central expanse, and a second elongate extension extending oppositely from the first elongate extension outwardly from the central expanse. Preferably, a central elongate extension extends intermediate the first elongate extension and the second elongate extension. The first elongate extension is fittable within a digit-receiving cavity of the glove, such as that intended to receive a thumb, the central elongate extension is fittable within another cavity of a glove, such as that intended to receive the middle finger of a hand, and the opposing elongate extension is fittable within a cavity of the glove corresponding to the pinkie of a hand.

17 Claims, 3 Drawing Sheets

BASEBALL GLOVE INSERT TRAINING AID

CROSS-REFERENCE TO RELATED APPLICATIONS

This application springs from, is based upon, and claims the benefit under 35 U.S.C. § 119 of prior-filed U.S. Provisional Patent Application Ser. No. 60/030,805, entitled, BASEBALL GLOVE INSERT TRAINING AID filed on Nov. 12, 1996, incorporated herein by reference.

BACKGROUND OF THE INVENTION

The present invention relates to an insert that provides excess stiffness to a baseball glove, such as a fielder's glove. By "excess stiffness," it is meant that the glove is too stiff to catch a moving ball easily. It prevents the player from being able to flex the glove, such that it cannot be used to clutch or grasp a ball one-handedly.

This excess stiffness forces a player wearing the glove with the insert inside the glove to compensate for the deficiencies of the glove, and use both hands when catching a moving ball. It also forces the player to develop what are known as "soft hands," since a player needs to move both hands in the direction that the ball is traveling at the time it is caught to improve the chances of maintaining the ball in the glove. The invention further teaches the player to assume a position in the direct path of the ball to maximize the chance of making a firm catch of the ball. It has been found that use of the insert of the present invention improves the ability of baseball players to catch balls when the insert is removed.

One of the most difficult habits to develop in players is the practice of centering on the incoming ball and to use both hands while making the catch. This may be due in part to the flexibility of most off-the-shelf baseball gloves, which allow a player to grasp or clutch the ball with the gloved hand. Although some players may consistently execute successful catches using one hand, there is a significant chance of dropping a thrown or hit ball if one-handed catching is used instead of two-handed catching. Furthermore, the use of both hands helps a player make a throw with the caught ball much more quickly, because the ungloved throwing hand is already in contact with the ball as part of making the catch.

Various devices are known to reduce the stiffness of baseball gloves, or to act as substitutes to a flexible baseball glove. For example, such devices are disclosed in U.S. Pat. Nos. 4,121,824, 4,208,051, 4,637,610, 4,802,699, 4,817,209, 4,874,168, 5,346,208, 5,601,285, and 5,671,477, the disclosures of which are incorporated herein by reference.

SUMMARY OF THE INVENTION

The present invention is an insert for a glove, preferably manufactured out of high-density polyurethane plastic. The insert preferably includes elongate extensions corresponding to the thumb, middle finger, and pinkie finger cavities of a baseball glove, and an enlarged central expanse corresponding to the palm or wrist area of a user. The elongate extensions extend into the corresponding cavities of a glove to provide excess stiffness to the glove. The central expanse interconnects the extensions, and preferably provides additional structure to the insert that is useful both when inserting and removing the insert from a glove.

It is an object of the present invention to provide a stiffening insert having several fingers for removable insertion into a baseball glove.

Additional objects and advantages of the present invention will be understood more readily after a consideration of the drawings and the Detailed Description of the Preferred Embodiment.

DETAILED DESCRIPTION OF THE PREFERRED EMBODIMENT

Figure 1:
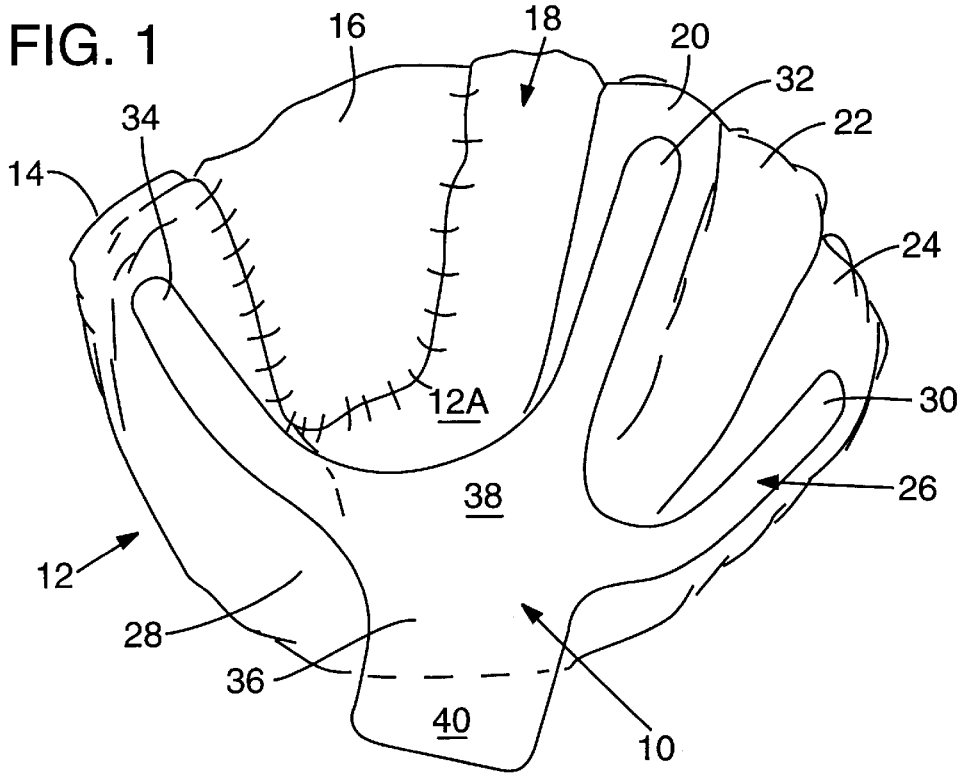
FIG. 1 is an isometric view of the preferred embodiment of stiffening insert of the present invention, shown as inserted into a transparent baseball glove for a right-handed thrower, when looking at the palm side of the glove.

Referring now to FIG. 1, a stiffening insert 10 is shown in combination with a typical baseball fielder's glove 12. Stiffening insert 10 is shown as it would be installed in glove 12, with glove 12 being transparent to depict the relationship of stiffening insert 10 to glove 12. Stiffening insert 10 is placed in the hand-receiving cavity of glove 12 so that stiffening insert 10 is between the padded front of glove 12 and a user's hand. Alternatively, a player may prefer to keep stiffening insert 10 between the back of glove 12 and the player's hand, so that stiffening insert 10 does not deaden the player's sense of a ball hitting glove 12.

Figure 2:
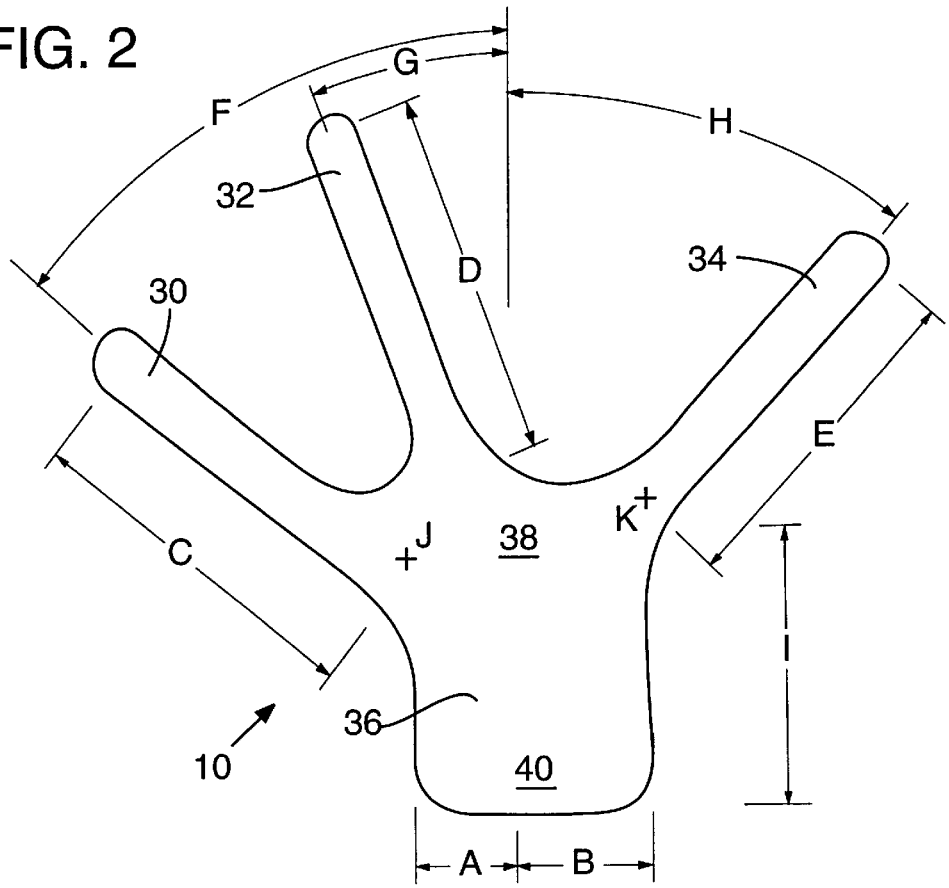
FIG. 2 is a plan view of the stiffening insert of FIG. 1, shown in a reverse or left-handed thrower position relative to FIG. 1.
Figure 3:
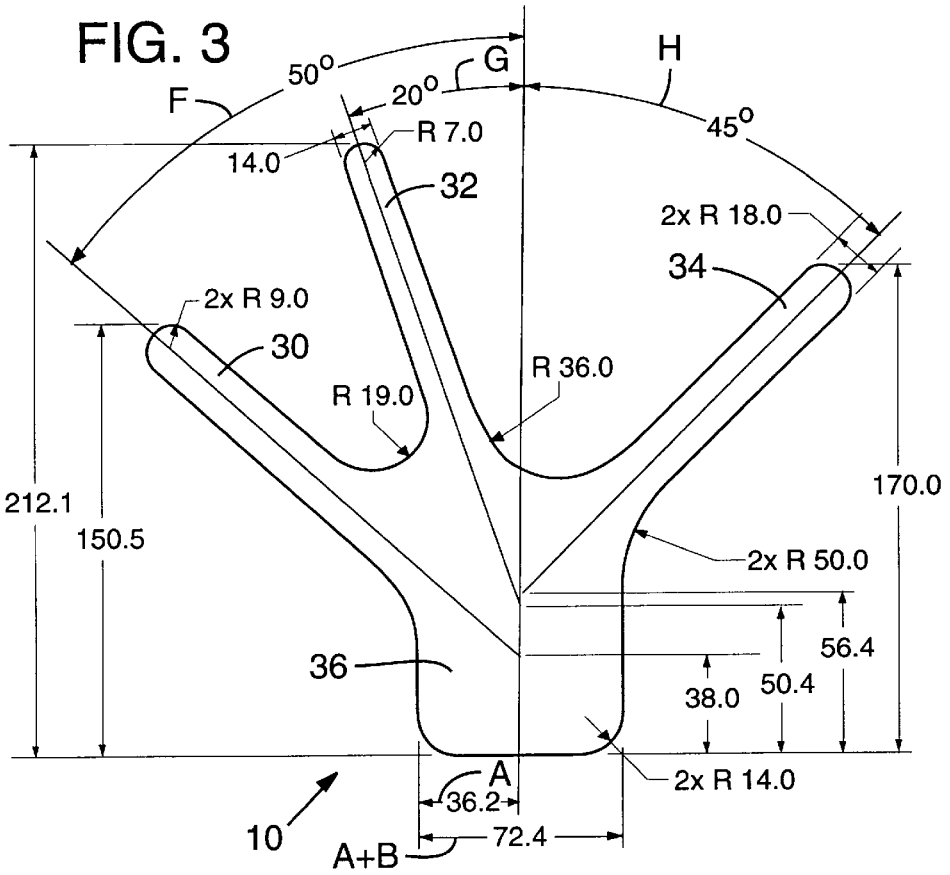
FIG. 3 is a plan view as in FIG. 2 with various dimensions in millimeters indicated for cutting the insert from a sheet of appropriate material.

Referring now to FIGS. 2 and 3 in addition to FIG. 1, stiffening insert 10 preferably is formed from a solid piece of sheet material having shape-retaining or resilient properties. One such material is high density impact polyurethane, having a durometer reading of between 60D and 75D, and a thickness of approximately 4-millimeters. The shape shown for stiffening insert 10 has been found to be particularly conducive to be inserted repeatedly into and removed from a conventional baseball or softball glove.

Glove 12 is conventional in construction and shape and has a thumb-receiving cavity 14 which is connected with webbing 16 to finger-receiving cavities 18, 20, 22 and 24. Commonly, finger-receiving cavities 18, 20, 22 and 24 are laced together, and radiate outwardly from a palm-receiving cavity. A back surface 26 of glove 12 usually has no padding. Front 12A of glove 12, including thumb 14, finger portions 18, 20, 22 and 24, and a heel 28 of glove 12, is often extensively padded.

Stiffening insert 10 is pushed into glove 12 through a hand-receiving opening in heel 28. First a pinkie finger 30 of stiffening insert 10 is started into pinkie-receiving cavity 24 of glove 12, then a middle finger 32 of stiffening insert 10 is started into middle finger-receiving cavity 20, and finally a thumb 34 of stiffening insert 10 is folded into thumb-receiving cavity 14 and the entire stiffening insert 10 is pushed into glove 12. With stiffening insert 10 so positioned, glove 12 is biased to an open position. The player's hand can be inserted with insert 10 in contact with the player's palm and fingers, between the player's hand and front 12A, or between the hand and back 26.

Fingers 30, 32, and 34 of insert 10 are interconnected by a central expanse 36 having an upper juncture region 38 and a lower gripping region 40. Preferably, as shown in FIG. 1, lower region 40 extends out of the palm-receiving cavity of glove 12 when fingers 30, 32, and 34 are fitted within glove 12. This facilitates removal of insert 10 from glove 12, and it also facilitates insertion of insert 10, by providing increased bearing surface area central to fingers 30, 32, and 34 of insert 10.

FIG. 2 includes reference characters for various dimensions that describe the geometry of stiffening insert 1. Dimension A is a pinkie portion of central expanse 36, and dimension B is a thumb portion of central expanse 36. Dimension C is the length of pinkie finger 30, dimension D is the length of middle finger 32, and dimension E is the length of thumb 34. Angles F, G and H are the angles of fingers 30 and 32, and thumb 34, respectively, relative to a reference line defined by heel dimensions A and B. Dimension I is the separation distance between upper region 38 and lower region 40 of central expanse 36.

Finger 30 extends oppositely from finger 34, and both fingers 30 and 34 extend outwardly from upper region 38. Finger 32 extends outwardly from upper region 38, intermediate fingers 30 and 34. Finger 30 and upper region 38 define a first intersection J therebetween, and finger 34 and upper region 38 define a second intersection K therebetween. The first intersection and the second intersection define therebetween width A+B for upper region 38. Upper region 38 and lower region 40 define a length I of central expanse 36, which is preferably at least as great as width A+B of upper region 38. Preferably, length I is measured approximately perpendicular to width A+B, as shown in FIG. 2.

FIG. 3 identifies the preferred dimensions for insert 10 when it is formed of high density polyurethane. The material and thickness may be varied, as may the outer dimensions. However, the dimensions shown in FIG. 3 have been found to produce excellent results for insert 10, when used by various players of various levels of skill, and with various sizes of gloves 12.

Insert 12 preferably is manufactured so that fingers 30, 32 and 34, and central expanse 36 are all coplanar when insert 10 is in a relaxed, unflexed free-standing condition, not inserted in glove 12. This may be accomplished by machining insert 10 from a planar sheet, or by molding insert 10 using a planar mold cavity. However, alternative embodiments of insert 10 may include a pre-shaping to be either concave or convex relative to the concave ball-receiving pocket of glove 12, thereby biasing insert 10 to provide desired modifications of the flexibility or stiffness of glove 12 when insert 10 is in use.

In FIG. 3, it will be seen that fingers 30 and 34 have approximately equal widths throughout a substantial portion of the fingers. Finger 32 has a width throughout a substantial portion of the central elongate extension that is less than eighty-percent of the approximately equal widths of fingers 30 and 34. This difference in width is important because it is believed to provide optimum structural stiffness of insert 10, without overly complicating the insertion and removal of insert 10 from glove 12.

Angles F, G and H are measured relative to central expanse 36. However, if measured relative to fingers 30, 32 and 34, several relationships are observed. Finger 32 extends at an angle relative to finger 30 of between twenty-degrees and forty-degrees, and preferably approximately thirty-degrees, and finger 34 extends at an angle relative to finger 32 at an angle of between fifty-five-degrees and seventy-five-degrees, preferably approximately sixty-five-degrees. Finger 30 extends at an angle relative to finger 34 of at least seventy-five-degrees, and preferably approximately ninety-five-degrees. The preferred angles are important because they allow a single version of insert 10 to be used in a wide variety of off-the-shelf baseball gloves, despite numerous variations in such gloves. It is believed that the increased flexibility of finger 32 allowed by its reduced width further accommodates variations in gloves 12.

Figure 4:
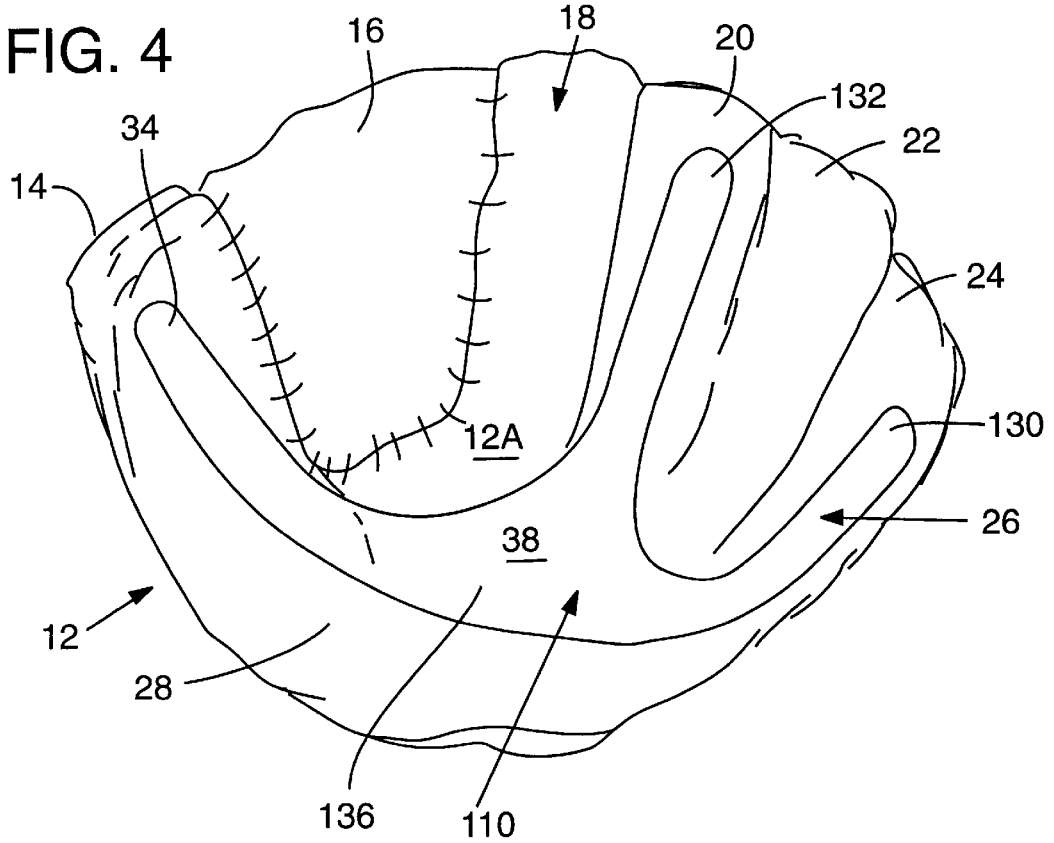
FIG. 4 is an isometric view of an alternative embodiment of the insert of the present invention, similar to that shown in FIG. 1.
Figure 5:
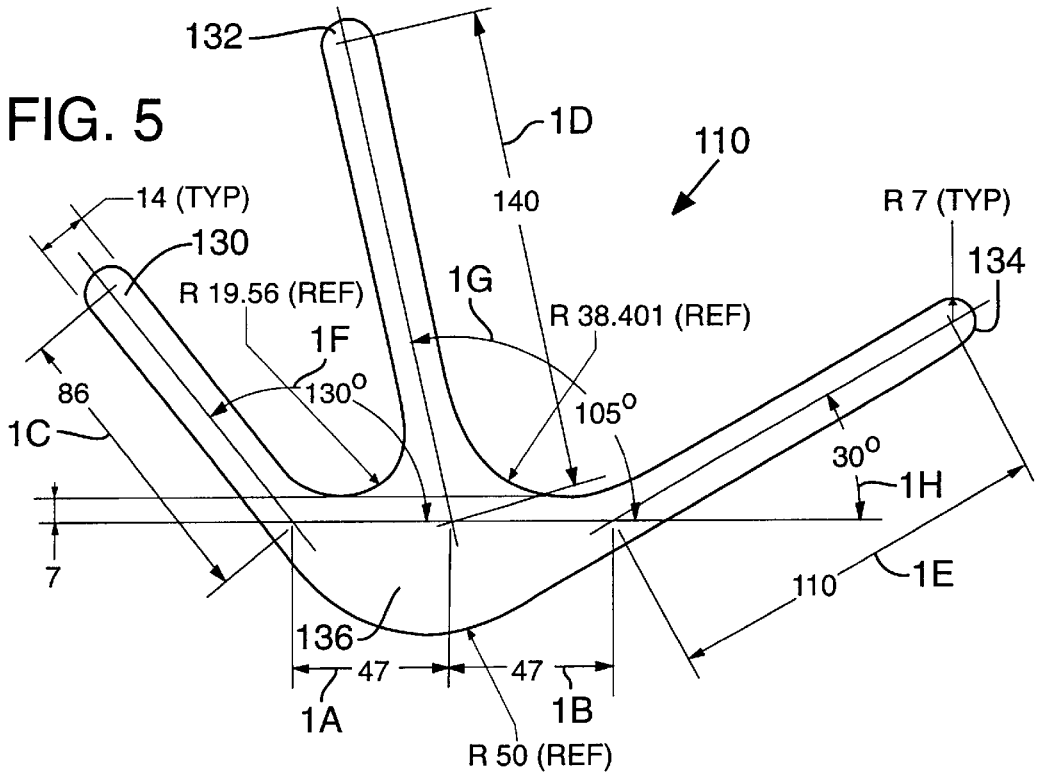
FIG. 5 is a plan view of an alternative embodiment of the insert of FIG. 1, with a substantially smaller central expanse.
Figure 6:
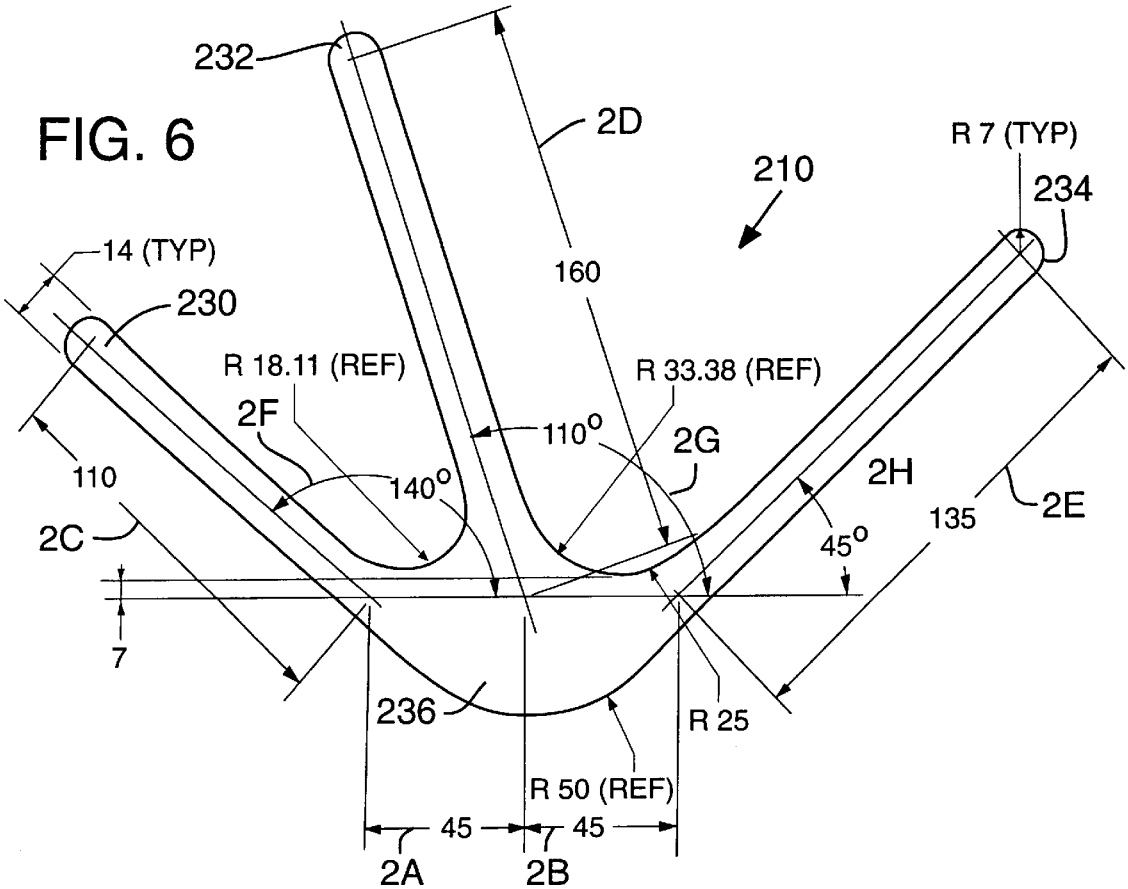
FIG. 6 is a plan view of an alternative embodiment of the stiffening insert shown in FIG. 5, showing alternative dimensions to those shown in FIG. 5.

In FIGS. 4 through 6, alternative embodiments of the invention are shown, identified as insert 110 and 210. The fingers of the inserts have been labeled 130, 132, and 134, and 230, 232, and 234, corresponding to the numbering used for the preferred embodiment. The embodiment of FIGS. 4 and 5 is slightly less expensive to manufacture, but it also is believed to be less functional because it lacks the protruding sides of the central expanse as shown in FIGS. 1 through 3. FIG. 6 presents alternative dimensions, for those situations in which a more nearly precise fit is desired than is accomplished with the one-size-fits-all dimensions of FIG. 3. However, very satisfactory results have been found using the dimensions of FIG. 3 for a wide variety of gloves, ranging from those for small children to those for large adults.

I claim:

1. An insert to provide stiffness to a baseball glove, the glove having cavities for receiving the digits and palm of a hand, the insert comprising:

a central expanse having a juncture region and a gripping region;

a first elongate extension extending outwardly from the juncture region; and a second elongate extension extending oppositely from the first elongate extension at an angle of at least seventy-five-degrees, outwardly from the juncture region;

wherein:

the first elongate extension is fittable within a digit-receiving cavity of a glove; and the second elongate extension is fittable within an oppositely extending digit-receiving cavity of a glove.

2. The insert according to claim 1, wherein the gripping region of the central expanse extends out of a palm-receiving cavity of a glove when the first elongate extension and the second elongate extension are fitted within a glove, thereby facilitating removal of the insert from a glove.

3. The insert according to claim 1, further comprising a central elongate extension extending intermediate the first elongate extension and the second elongate extension, outwardly from the juncture region, wherein the central elongate extension is fittable within a central digit-receiving cavity of a glove.

4. The insert according to claim 3, wherein the gripping region of the central expanse extends out of a palm-receiving cavity of a glove when the first elongate extension and the second elongate extension are fitted within a glove, thereby facilitating removal of the insert from a glove.

5. The insert according to claim 3, wherein:

the first elongate extension and the juncture region define a first intersection therebetween;

the second elongate extension and the juncture region define a second intersection therebetween;

the first intersection and the second intersection define therebetween a width for the juncture region of the central expanse; and the juncture region and the gripping region define a length of the central expanse approximately perpendicular to the width, and the length is at least as great as the width of the juncture region.

6. The insert according to claim 3, wherein:

the first elongate extension and the second elongate extension have approximately equal widths throughout a substantial portion of the first elongate extension and the second elongate extension; and the central elongate extension has a width throughout a substantial portion of the central elongate extension that is less than eighty-percent of the widths of the first elongate extension and the second elongate extension.

7. The insert according to claim 3, wherein:

the central elongate extension extends at an angle relative to the first elongate extension of approximately thirty-degrees.

8. The insert according to claim 7, wherein:

the second elongate extension extends at an angle relative to the first elongate extension of approximately ninety-five-degrees.

9. The insert according to claim 3, wherein:

the second elongate extension extends at an angle relative to the first elongate extension of approximately ninety-five-degrees.

10. The insert according to claim 1, wherein:

the first elongate extension and the juncture region define a first intersection therebetween;

the second elongate extension and the juncture region define a second intersection therebetween;

the first intersection and the second intersection define therebetween a width for the juncture region of the central expanse; and the juncture region and the gripping region define a length of the central expanse approximately perpendicular to the width, and the length is at least as great as the width of the juncture region.

11. The insert according to claim 1, wherein the central expanse, first elongate extension, and second elongate extension are substantially coplanar.

12. A semi-flexible insert for a baseball glove, comprising three outwardly extending fingers, the fingers being interconnected so that a central one of the fingers extends at an angle of between twenty-degrees and forty-degrees relative to an outer one of the fingers and at an angle of between fifty-five-degrees and seventy-five-degrees relative to another outer one of the fingers, wherein the insert is repeatedly insertable and removable from a baseball glove.

13. The insert according to claim 12, wherein the central one of the fingers extends at an angle of approximately thirty-degrees relative to the outer one of the fingers and at an angle of approximately sixty-five-degrees relative to the another outer one of the fingers.

14. The insert according to claim 12, further comprising a central expanse interconnecting the three outwardly extending fingers, the central expanse having a gripping region that extends out of a palm-receiving cavity of a glove when the three outwardly extending fingers are fitted within corresponding cavities of a glove, thereby facilitating removal of the insert from a glove.

15. The insert according to claim 14, wherein the intersection of the outer one of the fingers with the central expanse defines a first intersection;

the intersection of another of the outer fingers where the central expanse defines a second intersection;

the first intersection in the second intersection defined therebetween a width of the central expanse; and the gripping region of the central expanse is separated from the first intersection and the second intersection by a distance at least as great as the width of the central expanse.

16. The insert according to claim 14, wherein:

the outer one of the fingers and another outer one of the fingers have approximately equal widths throughout a substantial portion of the fingers; and the central one of the fingers has a width throughout a substantial portion of the central one of the fingers that is less than 80-percent of the widths of the outer ones of the fingers.

17. The insert according to claim 12, wherein the fingers are substantially coplanar.

* * * * *